US006035778A

United States Patent [19]

Uchiyama

[11] Patent Number: 6,035,778

[45] Date of Patent: Mar. 14, 2000

[54] STENCIL PRINTING METHOD AND MACHINE, STENCIL PRINTING PLATE AND METHOD OF PRODUCING THE SAME

[75] Inventor: Koichi Uchiyama, Ibaraki-ken, Japan

[73] Assignee: Riso Kagaku Corporation, Tokyo, Japan

[21] Appl. No.: 09/083,951

[22] Filed: May 26, 1998

[30] Foreign Application Priority Data

Jun. 9, 1997 [JP] Japan ..... 9-151267

[51] Int. Cl.[7] ..... B41C 1/14

[52] U.S. Cl. ..... 101/128.4; 101/128.21

[58] Field of Search ..... 101/33, 34, 114, 101/116, 128.21, 128.4, 129, 477, 125, 119, 131, 468, 472

[56] References Cited

U.S. PATENT DOCUMENTS

| | | | |
|---|---|---|---|
| 3,149,563 | 9/1964 | Wartman et al. | 101/125 |
| 3,979,550 | 9/1976 | Panken | 101/472 |
| 4,304,183 | 12/1981 | Loria et al. | 101/472 |
| 5,435,242 | 7/1995 | Kusch et al. | 101/142 |
| 5,662,039 | 9/1997 | Watanabe et al. | 101/116 |
| 5,809,881 | 9/1998 | Deschner et al. | 101/142 |
| 5,813,329 | 9/1998 | Tateishi et al. | 101/128.1 |

OTHER PUBLICATIONS

Patent Abstracts of Japan, vol. 010, No. 257 (M–513), Sep. 3, 1986 & JP 61 084279 A (Fuji Photo Film Co., Ltd.), Apr. 28, 1986.

*Primary Examiner*—Ren Yan
*Attorney, Agent, or Firm*—Kanesaka & Takeuchi

[57] ABSTRACT

A stencil printing plate is formed by perforating a film of a stencil sheet, and disposing a solid material on perforations of the film. The solid material includes a solvent soluble ink. when the solvent is supplied to the solid material, ink in the solid material is transferred to a sheet through the perforations.

4 Claims, 8 Drawing Sheets

STENCIL PRINTING METHOD AND MACHINE, STENCIL PRINTING PLATE AND METHOD OF PRODUCING THE SAME

BACKGROUND OF THE INVENTION

The present invention relates to a method of producing a stencil printing plate.

Stencil printing gains high evaluation because of high speed and low cost in printing, and easiness in operation; therefore, the printing method has been used in simplified printers all over the world in spite of the existent PPC or the offset duplicator.

However, the stencil printing still has unsolved problems such as a set-off due to ink control difficulty and occurrence of a spoilage sheet at a reusing time after a long-term non-use.

An object of the present invention is to provide a method of producing a stencil printing plate which has no problems of the conventional stencil printing machine such as the set-off due to ink control difficulty and the occurrence of spoilage sheet at a veusing time after a long-term non-use.

SUMMARY OF THE INVENTION

A method of stencil printing as defined in the first aspect of the present invention comprises preparing a perforated film closely on a layer including a solvent soluble ink, providing the layer with a solvent through perforations of the film by applying the solvent to the film so that a part of the layer is dissolved, and transferring the solvent soluble ink from the layer to a sheet placed over the film.

A method of stencil printing as defined in the second aspect of the present invention comprises preparing a perforated film closely on a layer including a solvent soluble ink, placing a sheet closely on the film, said sheet having a solvent applied thereon, said solvent being capable of dissolving the solvent soluble ink, dissolving a part of the layer by providing the layer with the solvent of the sheet through perforations of the film, and transferring the solvent soluble ink from the layer to the sheet.

A method of stencil printing as defined in the third aspect of the present invention comprises preparing a perforated film closely on a layer including a solvent soluble ink, providing the layer with a solvent through perforations of the film by directly applying the solvent to the film with a solvent supplying means so that a part of the layer is dissolved, and transferring the solvent soluble ink from the layer to a sheet placed over the film.

A stencil printing plate as defined in the fourth aspect of the present invention comprises a layer having a solvent soluble ink, and a film disposed closely over the layer.

In a stencil printing plate as defined in the fifth aspect of the present invention, the layer is disposed on a substrate in the stencil printing plate as defined in the fourth aspect.

In a stencil printing plate as defined in the sixth aspect of the present invention, the layer is a porous substrate including the solvent soluble ink, and the film is bonded to the porous substrate in the stencil printing plate as defined in the fourth aspect.

In a stencil printing plate as defined in the seventh aspect of the present invention, the porous substrate bonded to the film is attached to one surface of a flexible frame, and there is provided an adhesive layer covered by a separate paper on the other surface of the frame in the stencil printing plate as defined in the sixth aspect.

A method of producing a stencil printing plate as defined in the eighth aspect of the present invention comprises applying a fluid material to a film, said material including a solvent soluble ink, and hardening the fluid material on the film.

In a method of producing a stencil printing plate as defined in the ninth aspect of the present invention, the fluid material including the solvent soluble ink is applied to a porous substrate which is bonded to the film to form a stencil sheet, and the fluid material is hardened in the method of producing a stencil printing plate as defined in the eighth aspect.

A method of producing a stencil printing plate as defined in the tenth aspect of the present invention comprises applying a fluid material to a surface of either one of a film and a substrate, said material including a solvent soluble ink, bonding the other one of the film and the substrate to the material, and then hardening the material.

A method of producing a stencil printing plate as defined in the eleventh aspect of the present invention comprises perforating a film of a stencil sheet, said stencil sheet including at least the film, and disposing a solid material on perforations of the film, said solid material including a solvent soluble ink.

In a method of producing a stencil printing plate as defined in the twelfth aspect of the present invention, the solid material is applied to one surface of the film in the perforations so that the perforations of the film is filled with the solid material in the method of producing a stencil printing plate as defined in the eleventh aspect.

In a method of producing a stencil printing plate as defined in the thirteenth aspect of the present invention, the solid material is a solid ink sheet including a substrate and a solid ink disposed on one side of the substrate, said solid ink having the solvent soluble ink, and said solid ink sheet is disposed on one surface of the film in the perforations in the method of producing a stencil printing plate as defined in the eleventh aspect.

A stencil printing machine as defined in the fourteenth aspect of the present invention comprises a printing drum rotationally driven around a central axis of itself and adapted to receive a stencil printing plate around an outer circumferential surface of the drum. The stencil printing plate includes a layer of a solvent soluble ink and a film attached to the layer. The machine comprises a solvent supplying means for supplying a solvent to a sheet, said solvent being capable of dissolving the solvent soluble ink. The machine comprises a sheet supplying means for supplying the sheet to the printing drum. The machine comprises a pressing means for pressing the sheet supplied by the sheet supplying means on the outer circumferential surface of the printing drum.

In a stencil printing machine as defined in the fifteenth aspect of the present invention, the printing drum stores the stencil printing plate inside, the plate is wrapped around the outer circumferential surface of the drum after being supplied outside the drum, and then retrieved inside the drum after printing in the stencil printing machine as defined in the fourteenth aspect.

A stencil printing machine as defined in the sixteenth aspect of the present invention comprises a plate supplying means disposed inside the drum for winding a new stencil printing plate, a supply opening formed on the outer circumferential surface of the drum for guiding the new stencil printing plate supplied from the supplying means outside the drum, a retrieve opening formed on the circumferential surface of the drum for guiding the stencil printing plate inside the drum, said stencil printing plate being wrapped around the drum and used for printing, a retrieving means disposed inside the drum for winding the stencil printing plate used in the stencil printing machine as defined in the fifteenth aspect.

A stencil printing machine as defined in the seventeenth aspect of the present invention further comprises a perforating means disposed adjacent to the printing drum for perforating the film of the stencil printing plate in the stencil printing machine as defined in the sixteenth aspect.

In a stencil printing machine as defined in the eighteenth aspect of the present invention, the stencil printing plate is a stencil sheet comprising a porous substrate having the layer and a heatsensitive film attached to the porous substrate, a flexible frame is disposed on the porous substrate of the stencil sheet, the frame has an adhesive layer for adhering to the outer circumferential surface of the drum, and a supporting portion with an inner shape and a thickness corresponding to those of the frame is disposed on the outer circumferential surface of the drum in the stencil printing machine as defined in the fourteenth aspect.

The layer including the solvent is made from a material obstained by dissolving or dispersing a colorant in a forming material such as resin, fat and oil, and wax. The layer can be formed by applying the material on the substrate and then hardening the same. Further, so as to form the layer, the material may be applied on the film that is later perforated, or may be absorbed in the porous substrate of the stencil sheet. Further, after the stencil sheet that comprises the porous substrate and the film is perforated, the porous substrate may be coated with the material in a solid phase.

The forming material, such as resin, fat and oil, and wax, is properly selected in such a way that it can be dissolved or softened in swelling the solvent that is applied to the sheet used later in printing process. The material is preferably composed of a soluble one and a slightly soluble one in an appropriate blending, so that the ink with the colorant in the layer appropriately dissolves in the solvent. As the solvent that is applied to the sheet, there may be used water, hot water, alcohol, acetone, IPA (isopropyl alcohol), glycol and so on.

According to the present invention, next function can be attained. After attaching the stencil printing plate to the printing drum, the film of the stencil plate is perforated by a heatsensitive perforating means such as a thermal head. Otherwise, a stencil printing plate with a film pre-perforated is attached to the printing drum. Next, the sheet is thinly coated with the solvent, and then being transferred to the printing drum. The sheet just transferred is pressed against the printing drum by the pressing means. Otherwise, the solvent may be directly applied to the film of the stencil printing plate. The solvent passes through the perforations of the film of the stencil printing plate, and dissolves a part of the layer. The sheet absorbs the layer surface gaining fluidity. The solvent soluble ink transfers to the sheet.

DETAILED DESCRIPTION OF PREFERRED EMBODIMENTS

Figure 1:
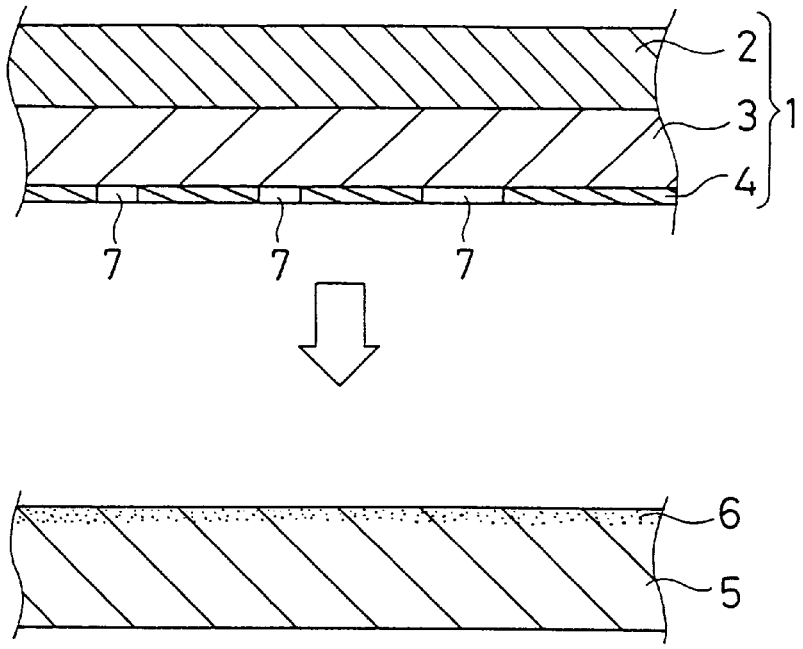
FIG. 1 is a sectional view of a stencil printing plate and a printing sheet in a first embodiment of the present invention.
Figure 2:
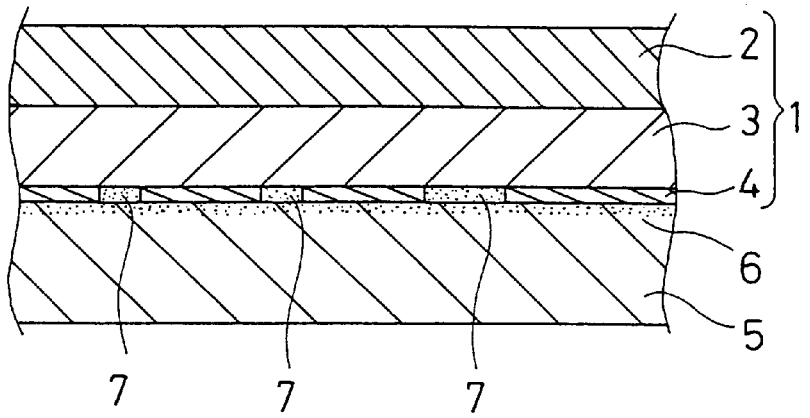
FIG. 2 is a sectional view of a stencil printing plate and a printing sheet closely attached to the plate in the first embodiment of the present invention.

Referring to FIG. 1 and FIG. 2, a first embodiment of the present invention will be explained. Firstly, an explanation will be made to a stencil printing plate in this embodiment.

As shown in FIG. 1, on one side of a substrate 2, there is disposed an ink layer 3. The ink layer 3 is a solvent soluble layer containing a colorant. The ink layer 3 of this embodiment is soluble in a solvent and solid at room temperature. The ink layer 3 of this embodiment is obtained by dispersing the colorant in a layer forming material such as resin, fat and oil, and wax. The ink layer 3 of this embodiment is in a thickness of approximately 100 $\mu$m.

The ink layer 3 of this embodiment is obtained by next processing. Firstly, basic dye, dispersant, oil, and solvent are added to a layer-forming material such as resin, fat and oil, and wax. Further, an appropriate binder is added to the material and all the compositions are mixed. Finally, the material is applied to one surface of the substrate 2 in either state of emulsion and solution, and then hardened.

As the wax, natural or synthetic wax may be used. The dispersant helps the dye to disperse in the solvent, and at the same time, helps the dye to dissolve in a solvent of a printing sheet during printing, thereby increasing printing density. As the dispersant, there may be used sorbic fatty acid ester, alkyl amine and so on. As the oil, there may be used either one of vegetable oil and mineral oil used for emulsion ink and also the mixture of these oils. Further, the solvent may be aromatic hydrocarbon that does not dissolve the dye, chlorinated hydrocarbon and so on. Further, as the binder, there may be used polyvinyl butyral resin, vinyl type resin such as copolymer vinyl chloride made from vinyl chloride and vinyl acetate, or ethyl cellulose.

When the material is applied to the substrate 2, any applying method among dipping, spraying, and roller coating is useful. If the quantity of applied material exceeds 300 g/m$^2$, the stencil printing method in the present invention can achieve a satisfactory printing quality.

A film 4 is adhered to a surface of the ink layer 3 (bottom surface in FIG.1). As the film 3, a heatsensitive film is used for example. As the heatsensitive film used in the present invention, there may be mentioned a polyester film, a polyethylene terephtalate film, a polyvinyl chloride film, a polyvinyl chloride-vinylidene chloride copolymer film and so on. The thickness varies according to the material, and is usually below 10 $\mu$m and preferably within a range from 0.5 $\mu$m to 6.0 $\mu$m. In this embodiment, the thickness is 2 $\mu$m.

The stencil printing plate 1 of this embodiment is formed in such a manner that the substrate 2 is applied with the material of the ink layer 3 in an appropriate thickness and the film 4 is attached thereon. The stencil printing plate is also formed in such a manner that the surface of the film 4 is applied with the material of the ink layer 3 in an appropriate thickness and the substrate 2 is attached thereon.

An explanation will be made to a printing sheet 5 on which printing is conducted by the stencil printing plate 1. As shown in FIG. 1, on a printing surface of the printing sheet, a solvent 6 that can dissolve the solvent soluble ink with the colorant is applied. As the solvent applied to the printing sheet 5, there may be selected solely or in combination among water, hot water, alcohol, acetone, IPA (isopropyl alcohol), glycol and so on.

An explanation will next be made to a stencil printing method for using the stencil printing plate 1 and the printing sheet 5. The film 4 of the stencil printing plate 1 is perforated by a heatsensitive perforating means such as a thermal head of a printer. As shown in FIG. 1, there are formed perforations 7 consisting of many holes in the film. As shown in FIG. 1 and FIG.2, the stencil printing plate 1 is placed over the printing sheet 5 and the film 4 is in contact with the surface of the sheet where the solvent 6 is applied to. Some kind of pressing means makes the stencil printing plate 2 and printing sheet 5, which are contacting with each other, to be in a closer contact. The solvent 6 applied to the printing sheet 5 passes through perforations 7 of the film and transfers to the ink layer 3, thereby dissolving a part of the ink layer 3. The solvent soluble ink contained in the dissolved ink layer 3 transfers to the printing sheet 5. On the printing sheet 5, there is formed a stencil printing image according to the perforated image.

A composition of the material contained in the ink layer 3 will be specifically shown for example.

(Composition Example 1)

| | |
|---|---|
| Wax | 300 g |
| Stearin Acid Calcium | 100 g |
| Spirit Nigrosine (Pigment) | 500 g |
| Mineral Oil | 100 g |

Materials listed above are mixed and melted by heating, and then applied to the substrate 2 such as the film.

(Composition Example 2)

| | |
|---|---|
| Solvent Black (Pigment) | 59 g |
| Polyvinylidene Chloride | 15 g |
| Vinyl Chloride-Vinyl Acetate Copolymer | 10 g |
| Polyvinyl Butyral | 20 g |
| Trichlene | 200 g |

Materials listed above are mixed and melted by heating, and then applied to the substrate 2 such as the film.

The stencil printing plate 1 of this embodiment thus explained is in a three-layer constitution including the substrate 2, ink layer 3, and the film. But it is sufficient for the plate to be provided with at least the ink layer 3 and the film for perforation. For example, the stencil printing plate 1 in the present invention can be manufactured by using a conventional stencil sheet that comprises a porous substrate and a heatsensitive sheet adhered thereon. In this case the material for the ink layer 3 is melted. After filling the porous substrate of the stencil sheet, the melted material is solidified. In this case the stencil printing plate 1 is in a two-layer constitution including the ink layer 3 and the film.

Otherwise, the ink layer 3 may be formed in such a manner that the material contained in the ink layer 3 is applied to the heatsensitive film in an appropriate thickness after being dissolved with a solvent, and then solidified. In this case the stencil printing plate 1 is also in a two-layer composition including the ink layer 3 and the film.

Further, in each constitution of the stencil printing plates 1 of the embodiments thus explained, there may be disposed a heat insulating layer between the ink layer 3 and the film 4. Providing that the heat insulating layer is disposed in this position, there is no fear that the ink layer 3 is unnecessarily dissolved by a heat emitted from the heatsensitive perforating means while perforating the film.

Figure 3:
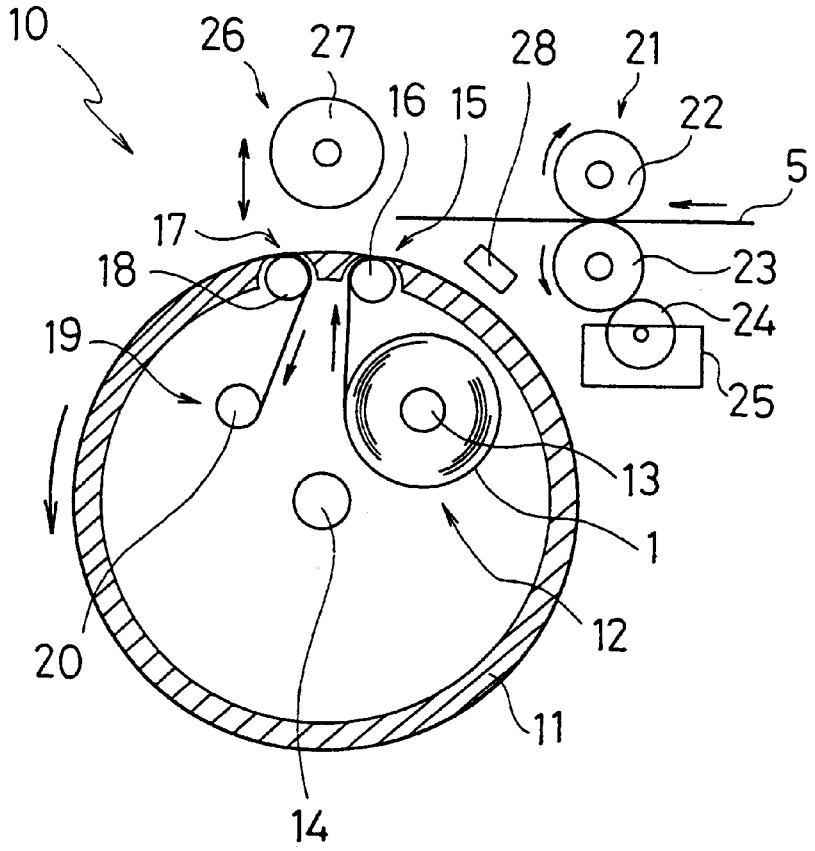
FIG. 3 is a sectional view of a stencil printing machine in a second embodiment of the present invention.

Referring to FIG. 3, a second embodiment of the present invention will be explained. A stencil printing machine in the present embodiment has a function of perforating the stencil printing plate 1 and conducting stencil printing. A printing drum 11 is a hollow body having a cylindrical wall. The drum 11 is driven by a driving means such as a motor to rotate around a horizontal central axis 14 of itself.

The stencil printing plate 1, explained by referring to FIG. 1 and FIG. 2, is stored inside the printing drum 11. This stencil printing plate 1 is wound in the shape of a roll with the film 4 outside, and rotationally supported on a supporting axis 13 of the plate supplying means 12 disposed inside the printing drum 11. The supporting axis 13 is parallel to a central axis 14 of the printing drum 11. The length in the axial direction of the stencil printing plate 1 supported on the supporting axis 13, namely the width of the drum 1, approximately corresponds with the length in the direction of the central axis 14 of the outer circumferential surface of the drum 11.

On the circumferential surface of the drum 11, a supply opening 15, namely a slit-like opening that is parallel to the central axis 14, is formed. A supply roller 16 is rotatably disposed adjacent to the supply opening 15 inside the drum 11. The new stencil printing plate 1 is pulled out from the supplying means 12, and sent outside the drum 11 through the supply opening 15 after being guided by the supply roller 16.

After being transferred to the outside, the stencil printing plate 1 is wound around the outer circumferential surface of the drum 11 along the rotating direction of the drum 11 with the film 4 outside.

On the circumferential surface of the drum 11, a retrieve opening 17, namely a slit-like opening that is parallel to the central axis 14, is formed. A retrieve roller 18 is rotatably disposed adjacent to the retrieve opening 17 inside the drum 11. The stencil printing plate 1 wound around the outer circumferential surface of the drum 11 is, after printing, retrieved inside the drum 11 through the retrieve opening 17 and the retrieve roller 17.

Inside the drum 11, a retrieving means 19 is disposed for rewinding the stencil printing plate 1 that is wound around the outer circumferential surface of the drum 11. The retrieving means 19 has a retrieve axis 20 for winding the stencil printing plate 1. The retrieving axis 20 is capable of being driven by a driving means. The retrieving axis 20 optionally winds the stencil printing plate 1 round itself.

A sheet supplying means 21 is disposed adjacent to the drum 11. The sheet supplying means 21 includes a pair of rollers, an upper feed roller 22 and a lower feed roller 23, which are driven by a driving means. A solvent supply means, or a solvent supply roller 24, contacts with the lower feed roller 23. The lower half of the solvent supply roller 24 dips into a solvent in a container 25. The solvent is capable of dissolving the ink layer 3 of the stencil printing plate 1.

The printing sheet 5 is supplied to the sheet supplying means 21 and coated with the solvent on the bottom surface while being sandwiched during conveyance. Then, the sheet 5 is conveyed to the upper of the drum 11.

A pressing means 26 is disposed just over the top of the drum 11. The pressing means 26 includes a pressing roller 27 that is vertically movable. The pressing roller 27 presses the printing sheet 5, transferred from the sheet supplying means 21, against the outer circumferential surface of the rotating drum 11. The bottom surface of the sheet 5 coated with the solvent is forced by a predetermined pressure to be close contact with the film 4 of the stencil printing plate 1. The printing sheet 5 is conveyed while being sandwiched between the drum 11 and the pressing roller 27.

Adjacent to the drum 11, a heatsensitive perforating means, or a thermal head 28, is disposed for perforating the film 4 of the stencil printing plate 1 that is wound around the outer circumferential surface of the drum 11.

A function of the stencil printing machine 10 will next be explained.

Firstly, the stencil printing plate 1 is perforated. The driving means drives the retrieving axis 20. If a used plate 1 is left on the outer circumferential surface of the drum 11, this plate 1 is retrieved inside the drum 11 through the retrieve opening 17 and wound round the retrieving axis 20. At the same timing, a new stencil printing plate 1 is pulled and transferred from the inside to the outside of the drum 11 through the supply opening 15 and conveyed along the outer circumferential surface of the drum 11.

The new stencil printing plate 1 is attached to the circumferential surface within a range from the supply opening 15 to the retrieve opening 17 in a clockwise direction as shown in FIG. 3. The thermal head 28 touches the stencil printing plate 1 on the drum 11. The drum 11 starts rotating, and the thermal head 28 is driven in synchronization with the rotation. A desired image is perforated on the film 4 of the stencil printing plate 1. As thus stated, if the perforating starts after the new plate 1 is wound around the drum 11, high accuracy perforation without distortion can be achieved.

As contrasted to the function thus explained, it is possible that the thermal head 28 perforates the new plate 1 transferring along the outer circumferential surface while the drum remains stopping. In this case, a transferring velocity of the stencil printing plate 1, which is retrieving by the retrieving axis 20, should be synchronized with a perforating velocity of the thermal head 28. In this case where transferring and perforating the plate 1 are conducted simultaneously, a processing time can be decreased as compared to the case where perforating is conducted after transferring the plate.

Next, stencil printing is conducted using the stencil printing plate 1. The printing drum 11 and the sheet supplying means 21 are driven in synchronization with each other. The printing sheet 5 is supplied to the sheet supplying means 21 and conveyed while being sandwiched between the feed roller 22 and the feed roller 23. During the conveyance, the bottom surface of the sheet 5 is coated with the solvent. Successively, the printing sheet 5 is conveyed to the upper of the drum 11. The pressing roller 27 presses the printing sheet 5, conveyed by the sheet supplying means 21, against the outer circumferential surface of the rotating drum 11. The bottom surface of the sheet 5 with the solvent is forced by a predetermined pressure to be close contact with the film 4 of the stencil printing plate 1. The printing sheet 5 is conveyed while being sandwiched between the drum 11 and the pressing roller 27. As explained before referring to FIG. 1 and FIG. 2, stencil printing is conducted with the solvent soluble ink contained in the ink layer 3 of the stencil printing plate 1.

Referring to FIGS. 4–7, a third embodiment of the present invention will be explained.

Figure 4:
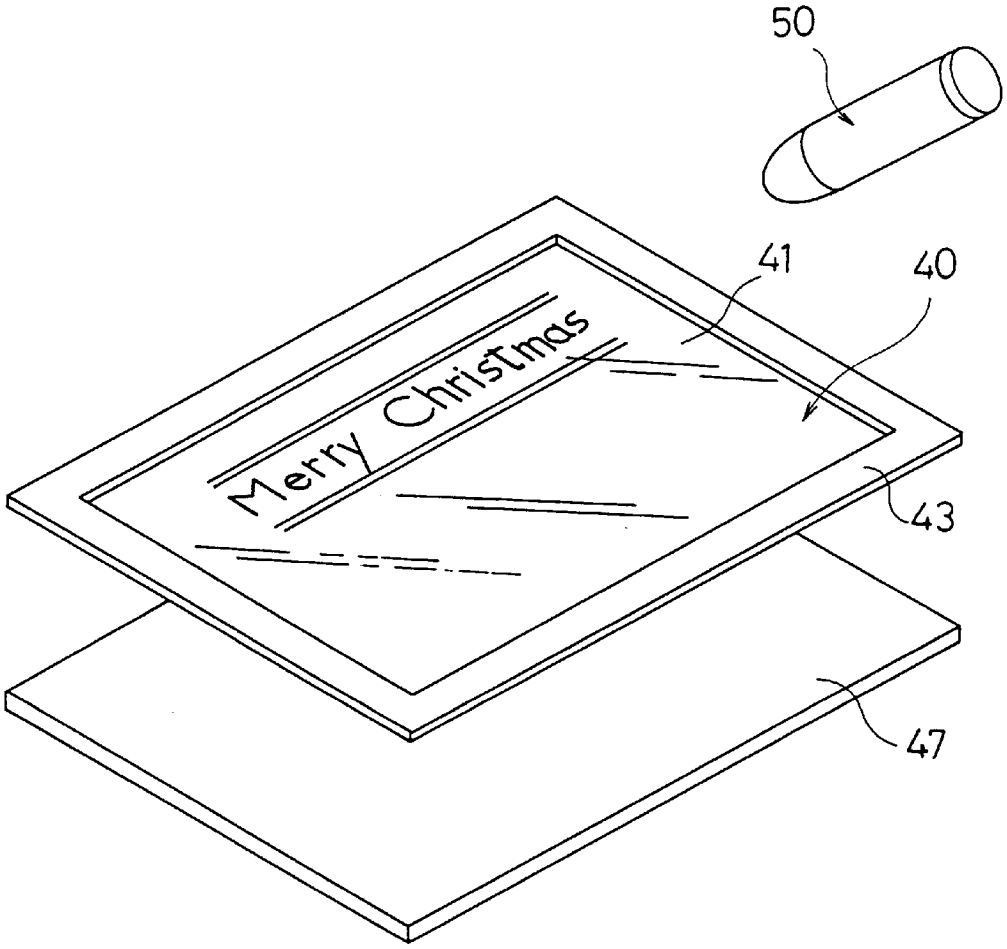
FIG. 4 is a perspective view showing a manufacturing process of a stencil printing plate in a third embodiment of the present invention.
Figure 5:
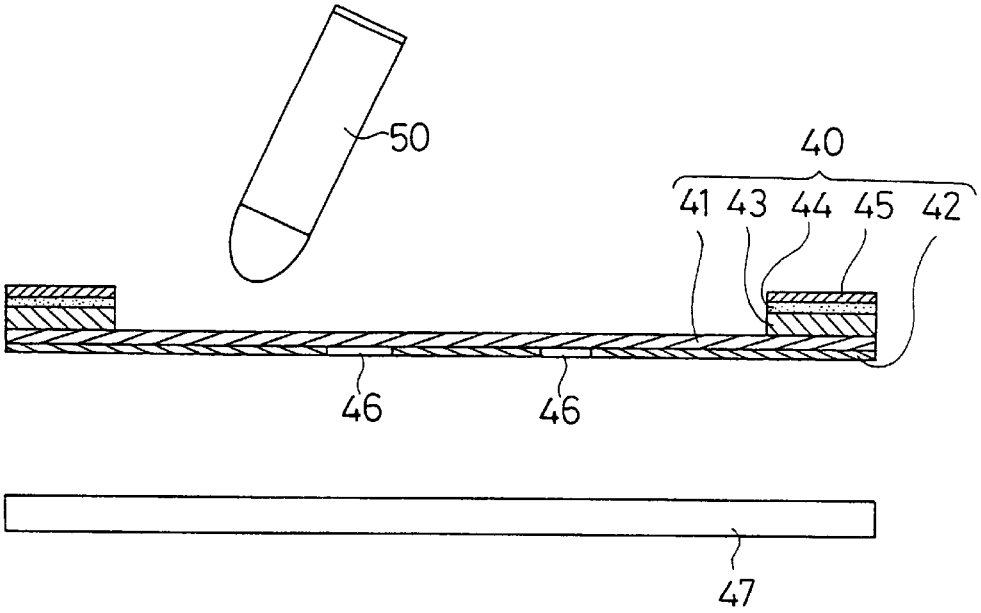
FIG. 5 is a sectional view showing a manufacturing process of a stencil printing plate in the third embodiment of the present invention.
Figure 6:
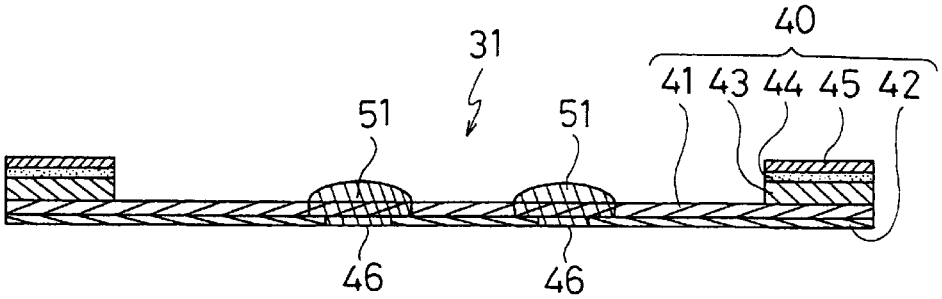
FIG. 6 is a sectional view showing a manufacturing process of a stencil printing plate in the third embodiment of the present invention.

A stencil printing plate 31 in the present embodiment is manufactured by a user oneself using a stencil sheet 40 and a solid ink 50 including the solvent soluble ink. The stencil sheet 40 as illustrated in FIGS. 4–6 comprises an ink permeable porous substrate 41 and a film 42 adhered to the substrate. A frame 43 is bonded to the porous substrate 41 of the stencil sheet 40. The frame 43 is rectangular and flexible. There is disposed an adhesive layer 44 of a pressure sensitive adhesive on the surface of the frame 43. A separate paper 45 covers the adhesive layer 44.

As the film 42, there can be mentioned a heatsensitive film such as, for example, a polyester film, a polyethylene terephtalate film, a polyvinyl chloride film, a polyvinyl chloride-vinylidene chloride copolymer film and so on. The thickness varies according to the material, and is usually below 10 $\mu$m and preferably within a range from 0.5 $\mu$m to 6.0 $\mu$m.

As the porous substrate 41, there can be mentioned sheet paper, woven or nonwoven fabric which are manufactured alone or in admixture from natural fibers such as Manila hemp, pulp, mitsumata, paper mulberry, Japanese paper; synthetic fibers such as polyester, nylon, vinylon and acetate; metal fibers and glass fibers, etc. The unit weight of the porous substrate 41 is preferably within a range from 1 to 20 g/m$^2$, more preferably within a range from 5 to 15 g/m$^2$ in view of stencil strength and ink permeability. Further, in the same way, the thickness of the porous substrate 41 is preferably within a range from 5 to 100 $\mu$m and, more preferably, within a range 10 to 50 $\mu$m.

As an adhesive making the porous substrate 41 adhere to the film 42, there can be mentioned, for example, epoxy resin, phenolic resin, poly vinyl acetate, ethylene-vinyl acetate copolymer, vinyl chloride-vinyl acetate copolymer, acrylate resin, polyester, polyurethane, styrene-butadiene copolymer, polyisobutylene, polyisoprene, butyl rubber, polyacrylamid, colophonium, terpene resin, polystyrene and so on.

The solid ink 50 including the solvent soluble ink is in the shape of a rod like a crayon. The material is identical to the composition example 1 or 2. It is preferable that some color types of the solid ink 50 are prepared by selecting pigments or dyes.

Before the stencil sheet 40 is perforated, an original having an image is prepared. The image should contain photothermal conversion material like carbon. The film 42 of the stencil sheet 40 is placed over the image of the original. After making the stencil closely contact with the original, a flash is emitted from the stencil sheet 40 side. The photothermal conversion material in the image gives out heat, by which the film 42 of the stencil sheet 40 is perforated in the image pattern. As illustrated in FIG. 5, perforations 46 (perforated holes) comprising many holes are formed in the film 42.

If the film material is properly selected, the stencil sheet 40 can be perforated by the heatsensitive perforating means such as the thermal head and so on. Besides, another perforating means except the heatsensitive method may be used.

As shown in FIGS. 4 and 5, the stencil sheet 40 having the film 42 downside is placed on a polypropylene plate 47 as a supporting base. The solid ink 50 of a desired color is rubbed from the porous substrate 41 on a desired position within the perforations 46 of the stencil sheet. The solid ink 50 adhered to the polypropylene plate 47 can be easily removed. The polypropylene plate 47 supports the stencil sheet 40. Hence, the solid ink 50 can be applied into the porous substrate 41 so that the holes of the perforations 46 are filled with the solid ink 50.

The stencil printing plate 31 is now completed. The stencil printing plate 31 comprises the porous substrate 41 and the film 42 bonded to the substrate, wherein the substrate includes the ink layer 51 with the solvent soluble ink.

Figure 7:
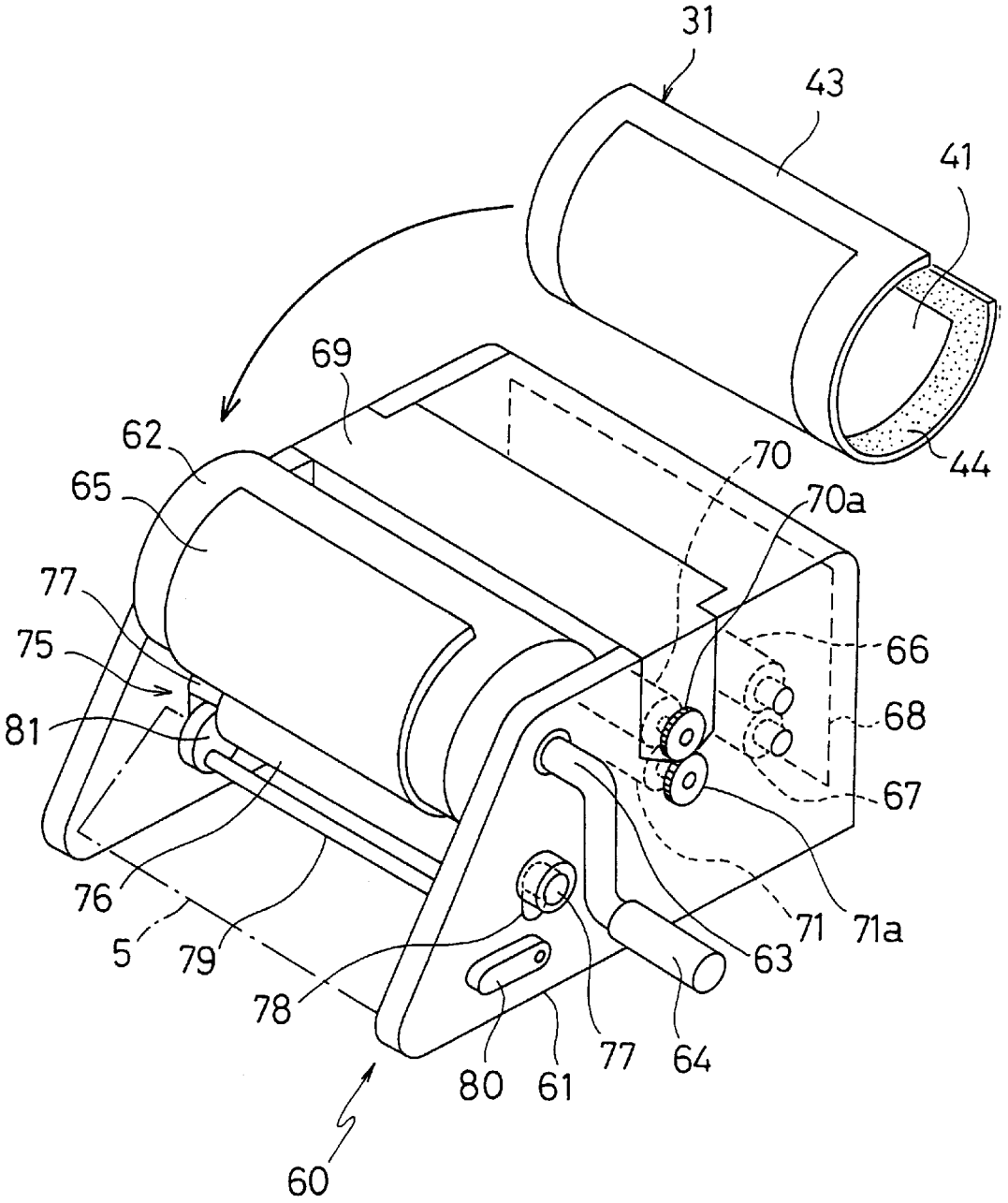
FIG. 7 is a perspective view of a stencil printing machine in the third embodiment of the present invention.

Referring to FIG. 7, an explanation will next be made to a stencil printing machine 60 for stencil printing by the use of the stencil printing plate 31.

A mounting cylinder 62 is rotatably disposed on a rotating axis 63 in a front side of a frame 61. A handle 64 in a crank shape is connected to the rotating axis 63. When an operator drives the handle 63, the mounting cylinder 62 rotates. On the outer circumferential surface of the mounting cylinder 62, a holder 65 is disposed for holding the stencil printing plate 31. The holder 65 is rectangular. The shape and the thickness of the holder 65 correspond with those of the frame 43 of the stencil printing plate 40. The holder 65 is made from flexible material or elastic material such as a hard sponge. As illustrated in FIG. 7, after being rolled, the stencil printing plate 31 is attached to the outer circumferential surface of the mounting cylinder 62 in such a manner that the holder 65 is inserted in the frame 43. The adhesive layer 44 of the frame 43 detachably adheres to the outer circumferential surface of the mounting cylinder 62. The porous substrate 41 is contacted with the surface of the holder 65.

A pair of feed rollers 66, 67 is disposed in a rear side of the frame 61 as a sheet feeding means. The feed rollers 66,67 rotate along with the driving of the mounting cylinder 62, thereby conveying a printing sheet 5 supplied through an opening 68 in the rear side of the frame 61 toward the mounting cylinder 62.

Between the mounting cylinder 62 and the feed rollers 66, 67, there is disposed a solvent supplying cassette 69 as a solvent supplying means. The solvent supplying cassette 69 is detachable from the frame 61. Within the solvent supplying cassette 69, a solvent is stored. The solvent stored in the solvent supplying cassette 69 is capable of dissolving the solid ink 50. The solvent supplying cassette 69 has an opening through which the solvent is supplied, where a driven roller 70 is disposed. On the side surface of the supplying cassette 69, a driven gear 70*a* fixed to the driven roller is disposed. In the frame 61, a drive roller 71 is disposed in a position where the solvent supplying cassette 69 is installed. The drive roller 71 rotates along with the driving of the mounting cylinder 62. On the side surface of the frame 61, a drive gear 71*a* fixed to the drive roller 71 is disposed. When the supplying cassette 69 is installed in a regular position, the driven roller 70 and the drive roller 71 constitute the pair of feed rollers as the sheet feed means, and the driven gear 70*a* and the drive gear 71*a* are engaged with each other. The printing sheet 5 transferred from the feed rollers 66,67 is conveyed to the bottom of the mounting cylinder 62 while being sandwiched between the drive roller 71 and the driven roller 70. During the conveyance the upper surface of the printing sheet 5 is coated with the solvent of the supplying cassette 69 by the driven roller 70.

Beneath the mounting cylinder 62, a pressing means 75 is disposed. The pressing means 75 presses the printing sheet 5 conveyed by the driven roller 71 and the drive roller 70 against the outer circumferential surface of the mounting cylinder 62. The pressing means 75 includes a pressing roller 76. The pressing roller 76 is rotatable around a supporting axis 77 that is parallel to the rotating axis 63 of the mounting cylinder 62. The both ends of the supporting axis 77 are movably engaged with vertical grooves formed on the frame 61 so that the supporting axis 77 is vertically movable. The pressing means 75 includes a release mechanism of the pressing roller 76. The release mechanism comprises an operating axis 79, an operating lever 80 and an operating cam 81. The operating axis 79 is rotationally disposed in the frame 61. The operating lever 80 is fixed to one end of the operating axis 79 outside the frame 61. The operating cam 81 is disposed on the operating axis 79 in the frame 61 and in contact with the supporting axis 77 of the pressing roller 76. In normal use, the pressing roller 76 is disposed so that it is almost in contact with the stencil printing plate 31 attached to the mounting cylinder 62. This is the regular position for printing. In the case where problem like printing sheet jamming arises, the pressing roller 76 is lowered by operating the lever 80, so that a necessary space is provided between the pressing roller 76 and the mounting cylinder 62.

Next, an explanation will be made to an operation of the stencil printing machine.

The stencil printing plate 31 as illustrated in FIG. 6 is attached to the outer circumferential surface of the mounting cylinder 62. Namely, as illustrated in FIG. 7, the stencil printing plate 31 is rolled in approximately a cylindrical shape, and attached to the outer circumferential surface of the mounting cylinder 62 in such a manner that the holder 65 is inserted in the frame 43. The adhesive layer 44 of the frame 43 adheres to the outer circumferential surface of the mounting cylinder 62. The stencil printing plate 31 is fixed to the mounting cylinder 62.

The operating lever 80 is set in a position as illustrated in FIG. 7. Since the operating cam 81 pushes up the supporting axis 77 of the pressing roller 76, there is an appropriate space provided between the pressing roller 76 and the mounting cylinder 62. The handle 64 is operated to rotate the mounting cylinder 62. The feed rollers 66,67 and the drive roller 71 rotate along with the rotation of the mounting cylinder 62. The printing sheet 5 is supplied to between the feed rollers 66,67 from the rear side of the frame 61. The printing sheet 5 is conveyed by the feed rollers 66,67 and further transferred by the driven roller 70 of the solvent supplying cassette 69 and the drive roller 71 of the frame 61 while being sandwiched therebetween. While being transferred by the drive roller 71 and the driven roller 70, the printing sheet 5 is coated with the solvent on the upper surface. The printing sheet 5 with the solvent coated is sent between the mounting cylinder 62 and the pressing roller 76.

The printing sheet 5 is sandwiched between the stencil printing plate 31 of the mounting cylinder 62 and the pressing roller 76. The pressing roller 76 presses the printing sheet 5 against the stencil printing plate 31. The upper surface of the printing sheet 5 and the film 42 of the stencil printing plate 31 are in close contact with each other. The distance between the pressing roller 76 and the mounting cylinder 62 is so arranged that the holder 65 supporting the back of the plate 31 is slightly deformed while being pressed by the pressing roller 76 when the sheet 5 is pressed against the plate 31. Thus constituted, the printing sheet 5 is stably contacted with the stencil printing plate 31.

The solvent applied on the sheet 5 transfers to the surface of the ink layer 51 of the porous substrate 41, thereby dissolving a part of the ink layer 51. The solvent soluble ink contained in the dissolved ink layer 51 transfers to the printing sheet 5 through the perforations formed in the film 42. On the printing sheet 5, a stencil printing image is formed according to the perforated image. The printed sheet 5 is discharged toward the front side of the frame 61 through the gap between the mounting cylinder 62 and the pressing roller 76.

According to the present embodiment, the stencil printing plate having the solid ink can be manufactured by using the conventional stencil sheet 40 comprising the porous substrate 41 and the film 42. Further, if solid inks in many colors are used, a stencil printing plate that is capable of conducting multi-color printing by one-time can be obtained.

Next, a fourth embodiment of the present invention will be explained referring to FIGS. 8–10.

A stencil printing plate 90 of this embodiment is manufactured by an operator oneself by using a stencil sheet 91 and a solid ink sheet 92 containing the solvent soluble ink. The stencil printing plate 90 as illustrated in FIG. 8 is such that a film 93 is adheres to a frame 94. The frame 94 is rectangular and flexible. On the surface of the frame 94, there is formed an adhesive layer of pressure sensitive adhesive, which is covered by a separate paper 95.

Figure 8:
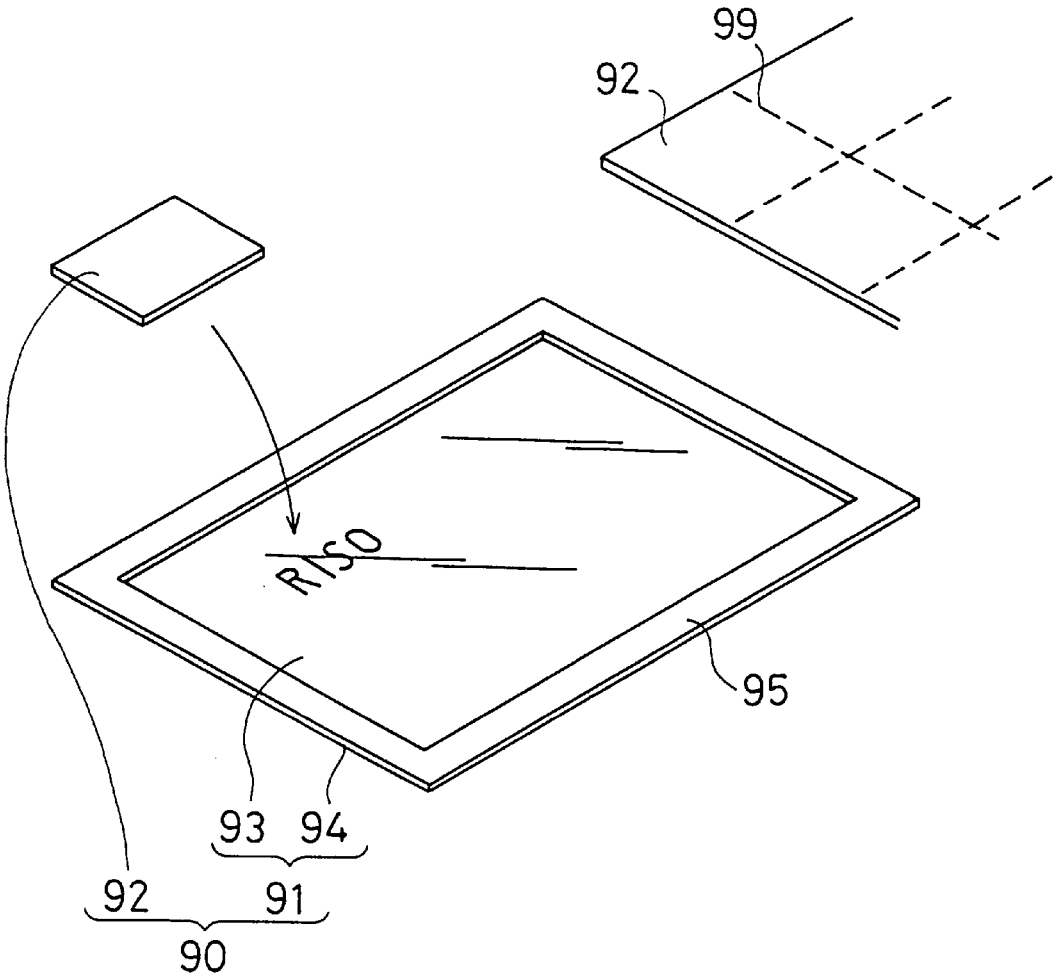
FIG. 8 is a sectional view showing a manufacturing process of a stencil printing plate in a fourth embodiment of the present invention.
Figure 9:
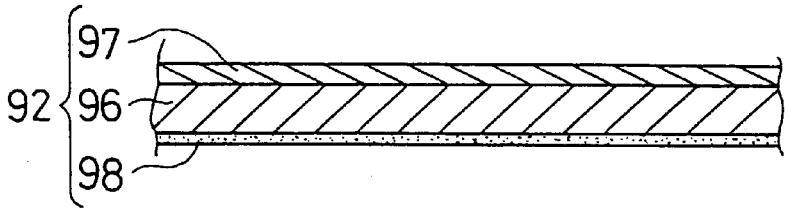
FIG. 9 is a sectional view of a stencil printing plate in the fourth embodiment of the present invention.

The solid ink sheet 92 as illustrated in FIGS. 8 and 9 is such that the solid ink 96 containing the solvent soluble ink is disposed over one surface of a substrate 97. On the surface of the solid ink 96, a coating layer 97 is formed to avoid operator's hands from being filthy. However, since this coating layer 98 is soluble in the solvent, there arises no inconvenience in printing. There is formed scores 99 in the solid ink sheet 92, thus the sheet 92 can be cut off along the scores in an adequate size at use.

The stencil printing plate 91 is now perforated. The perforating method may be the same as that of the embodiment as illustrated in FIG. 5, or may be conducted by using a heatsensitive perforating means such as a thermal head and so on. As illustrated in FIG. 8, the solid ink sheet 92 cut in an adequate size is placed only over the perforated portion of the stencil printing plate 91 from the frame 94 side, thereby being attached there by adhesion of the coating layer 98. A method in the following printing process is identical to that of the embodiment as illustrated in FIGS. 5–7.

Figure 10:
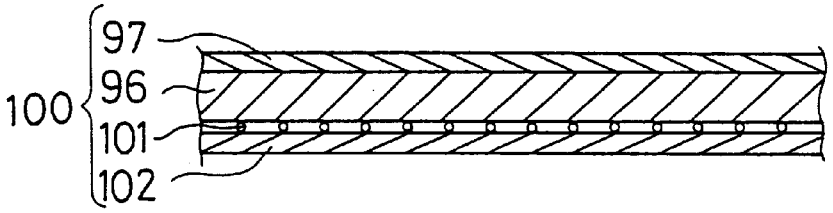
FIG. 10 is a sectional view of another stencil printing plate in the fourth embodiment of the present invention.

FIG. 10 shows modification of the solid ink sheet in the present embodiment. This solid ink sheet 100 comprises a substrate 97, a solid ink 96 disposed on one surface of the substrate 97, a weak adhesive layer 101 formed on the surface of the solid ink 96 in a dot-line, and a separate paper 102 covering the weak adhesive layer 101. In use, after the separate paper 102 is removed, the solid ink sheet 100 is attached to the film 93 of the stencil sheet 91.

Figure 11:
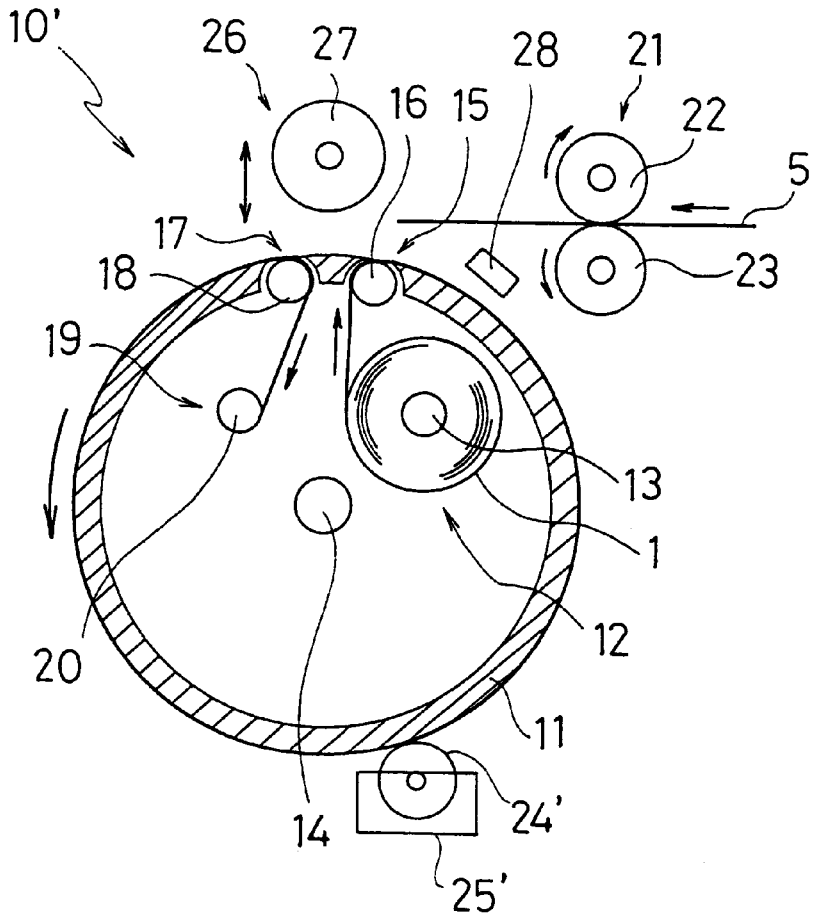
FIG. 11 is a perspective view of a stencil printing machine in a fifth embodiment of the present invention.

Next, a fifth embodiment of the present invention will be explained referring to FIG. 11. The portions common to the second embodiment are indicated by the same numerals as in the second embodiment and the explanation will be omitted for clarity. A solvent supply roller 24', or the solvent applying means in this embodiment, is so arranged that it selectively touch the printing drum 11 or leave therefrom. Thus the solvent supply roller 24' can be directly contacted with the film of the stencil printing plate 1. The lower half of the solvent supply roller 24' is soaked in the solvent in a container 25'.

An explanation will next be made to an operation of the stencil printing machine 10'. In this embodiment, since the solvent supply roller 24', as the solvent applying means, is so arranged that it selectively touch the printing drum 11 or leave therefrom, the film of the stencil printing plate 1 is directly applied with the solvent. The solvent applied penetrates into the ink layer 3 through the perforations of the stencil printing plate 1, thereby dissolving a part of the ink layer. Since ink contained in the ink layer is slow-soluble ink, the dissolved ink does not excessively flow out. The dissolved ink is absorbed properly in the printing sheet 5 along with the rotation of the printing drum 11.

In the case where water is used as the solvent, the solvent consumption can be controlled smaller by providing the surface of the stencil printing plate 1 with a water repellent finishing.

According to the present invention, a printing sheet on which a solvent is applied is disposed closely on a perforated film that is in close contact with a ink layer, then the ink layer is dissolved by the solvent, and the dissolved ink layer with a colorant is transferred to the printing sheet. According to such constitution, a printed matter without set-off can be obtained since only a necessary amount of ink is transferred to the printing sheet.

Further, according to the present invention, there is no fear that ink-leakage arises because the ink layer is solid.

Still further, according to the present invention, it is unnecessary to provide inside the printing machine with an ink supplying mechanism since a portion having an image, i.e. a film, and ink, i.e. an ink layer, are integrated. As compared to the conventional stencil printing machine, a mechanism for supplying and discharging a printing plate can be simplified. Also, consumable supplies can be exchanged easily.

What is claimed is:

1. A method of producing a stencil printing plate, comprising:

perforating a film of a stencil sheet, and applying a solid material on one surface of the film to fill the solid material in perforations of the film, said solid material having solvent soluble ink.

2. A method of producing a stencil printing plate according to claim 1, wherein said stencil sheet further includes an ink permeable substrate fixed on one side of the film, said solid material being filled in the perforations through the substrate.

3. A method of producing a stencil printing plate according to claim 2, wherein said solid material includes a plurality of solid members different in colors, a desired solid member being applied onto the ink permeable substrate.

4. A method of producing a stencil printing plate according to claim 3, wherein a supporting base is placed under the film when the solid material is applied to the stencil sheet.

* * * * *